United States Patent [19]

Weeks

[11] 4,288,991

[45] Sep. 15, 1981

[54] REFRIGERATION AND HEATING IMPROVEMENT

[76] Inventor: Harold R. Weeks, 1212 North St., Bowling Green, Ohio 43402

[21] Appl. No.: 671,746

[22] Filed: Mar. 30, 1976

[51] Int. Cl.[3] ..... F25B 39/04; F25D 23/12

[52] U.S. Cl. ..... 62/183; 62/258

[58] Field of Search ..... 62/183, 238, 258, 261, 62/513, 181

[56] References Cited

U.S. PATENT DOCUMENTS

| | | | |
|---|---|---|---|
| 2,786,337 | 3/1957 | Spring | 62/258 |
| 2,845,780 | 8/1958 | Conklin et al. | 62/258 |
| 3,308,633 | 3/1967 | Kritzer | 62/239 |
| 3,481,152 | 12/1969 | Seeley | 62/183 |
| 3,633,376 | 1/1972 | Miner | 62/183 |
| 3,926,008 | 12/1975 | Webber | 62/238 |
| 3,965,696 | 6/1976 | Thomason | 62/238 |

*Primary Examiner*—William E. Wayner
*Assistant Examiner*—R. J. Charvat
*Attorney, Agent, or Firm*—John C. Purdue

[57] ABSTRACT

In a device for utilizing the heat of a condenser in refrigeration apparatus for heating; including means for monitoring the heat and pressure within fluid conduit means in regrigeration apparatus; and means for incorporating this apparatus within a table structure to provide storage and serving facilities for food and beverages at predetermined temperatures.

9 Claims, 5 Drawing Figures

REFRIGERATION AND HEATING IMPROVEMENT

This invention relates generally to refrigeration apparatus. More particularly, this invention relates to refrigeration apparatus in which condenser portions thereof are utilized to provide heat in a predetermined manner.

In the past, attempts have been made to utilize the condenser portion of refrigeration apparatus to provide heat. For example, U.S. Pat. No. 3,308,633 issued to Kritzer discloses a heating and cooling refrigeration system. A table having a warming plate and a refrigeration chamber is disclosed. The condenser can be utilized to keep food warm at a temperature of 135 degrees F. However, no provision is made for substantial heat provision such as in a range of 180 degrees F. and above. Furthermore, there are no separate cooling facilities for different ranges in temperature. No provision is made for a quick cooling unit or extremely low temperatures, nor is there provision for immediate cooling provided in a localized area such as for glasses. Consequently, efforts such as that discussed above with respect to the Kritzer device have not provided all of the facility and ranges of temperatures for keeping various foods at optimum temperatures for storage and serving.

Other attempts have been provided in the past utilizing a condenser of a refrigeration apparatus for provision of heat. For example, U.S. Pat. No. 2,412,774 issued to Hoffman discloses a condenser heated compartment. While somewhat higher temperatures may be available in prior art devices such as the Hoffman device, in the heating element, nevertheless, no convenient structure such as a table utilizing such higher temperature devices is provided. No separate table structure is provided for cooling elements in localized areas such as for glasses on the top of the table is disclosed. Again, no quick cooling chamber is provided.

A similar device is disclosed in U.S. Pat. No. 3,481,154 issued to Johnson relating to means to retain drink and food items at their prepared temperature. Again, serious limitations are inherent in the structure disclosed in devices such as the Johnson device limiting the upper limit of temperature in the heating device and, also, not providing the desired range of temperatures in cooling such as localized cooling for beverages in glasses at one temperature and a still lower temperature at a quick cooling device. Furthermore, as in the above two immediately cited examples of prior art, again, no convenient table structure providing ready access, during service of food cr beverages, at the desired cooling and heating devices.

Other attempts have been made in the past to provide combination heating and cooling devices. But, these other devices, other than the ones mentioned specifically above with respect to utilizing the condenser in a refrigeration cycle, do not use such a condenser. These other devices rely on separate heating and cooling devices with consequent losses of efficiency and increased costs of operation due to increased energies required to fuel both devices. All of the types of devices mentioned specifically above suffer from an inability to provide an override condensing or secondary condenser for purposes of maintaining and monitoring the heat and pressure within the refrigeration condensation cycle at predetermined desirable levels. A lack of this provision not only has put severe limitations on upper limits to the heating device and severe limitations on minimum temperatures of the cooling device, but, in addition, failed to provide maximum efficiency that would be obtainable by monitoring the heat and pressures at predetermined levels within the condensation and compression cycles of operation.

By lacking a secondary heat dissipation condenser, the aforementioned prior art devices are incapable of serving as a heat servomechanism in providing the monitoring without direct observation by a human intermediary.

Accordingly, it is an object of this invention to provide a combined heating and cooling device within a table structure to provide at convenient places for service and storage of food and beverages at predetermined ranges of temperatures for both cooling and heating.

It is a further object of this invention to provide a convenient means of storage of foods and beverages at predetermined temperatures both for heating and for cooling purposes that utilize the energy otherwise dissipated in a condensr of a refrigeration cycle to provide the heat.

It is a still further object of this invention to provide a table structure with heating and cooling devices, utilizing a primary condenser of a refrigeration cycle for the provision of heat, with a heat reservoir dissipating mechanism that is actuated responsive to predetermined levels of pressure or temperature within the fluid conduits in the refrigeration cycle.

These and other objects of this invention are achieved by the provision of a compressor, condenser, and fluid conduit means in a refrigeration cycle of refrigeration apparatus, in which heat is conducted and insulated, within predetermined limits to provide predetermined temperature ranges for heating and cooling. Separate evaporators are provided in the refrigeration cycle at predetermined temperature ranges that can be preselected for different cooling temperatures. More particularly, one array of such evaporators are at one predetermined temperature and another array of evaporators are at another predetermined temperature. Additionally, means responsive to pressure or temperature within the fluid conduit connecting the compressor, evaporators, and a condenser is provided. Responsive to the actuation of this means, heat energy dissipating means such as a fan are utilized in conjunction with a secondary condenser to dissipate heat when a predetermined pressure or temperature is reached. The threshold temperature or pressure with response to heat is bistably actuating in that when the critical temperature or pressure is exceeded, the heat dissipation means is conditioned for operation, and when the temperature or pressure drops below the threshold, the heat dissipation means is rendered inoperable.

Specially insulated means for relatively higher temperature cooling means, such as those for provision of glasses containing beverages on the top of the table, containing the aforementioned refrigeration cycle apparatus, is provided. Special material such as urethane foam to insulate between an inner and outer metal structure that is highly heat conductive is provided for maintenance of temperature at preselected relatively higher levels. These refrigeration means are provided with heat sinks in the form of evaporators connected to the aforementioned refrigeration cycle. Additional evporators in conjunction with additional heat insulating apparatus is provided in quick cooling apparatus at a relatively lower temperature than the aforementioned relatively higher temperature for the glass cooling apparatus.

These and other objects of this invention can be appreciated from the following specifications and claims.

ON THE DRAWINGS

Before explaining the present invention in detail, it is to be understood that the invention is not limited in its application to the details in construction and arrangement of parts illustrated in the accompanying drawings since the invention is capable of other embodiments and of being practiced or carried out in various ways.

Also, it is to be understood that the phraseology and terminology employed herein are for the purpose of description and not of limitation.

AS SHOWN ON THE DRAWINGS

Figure 1:
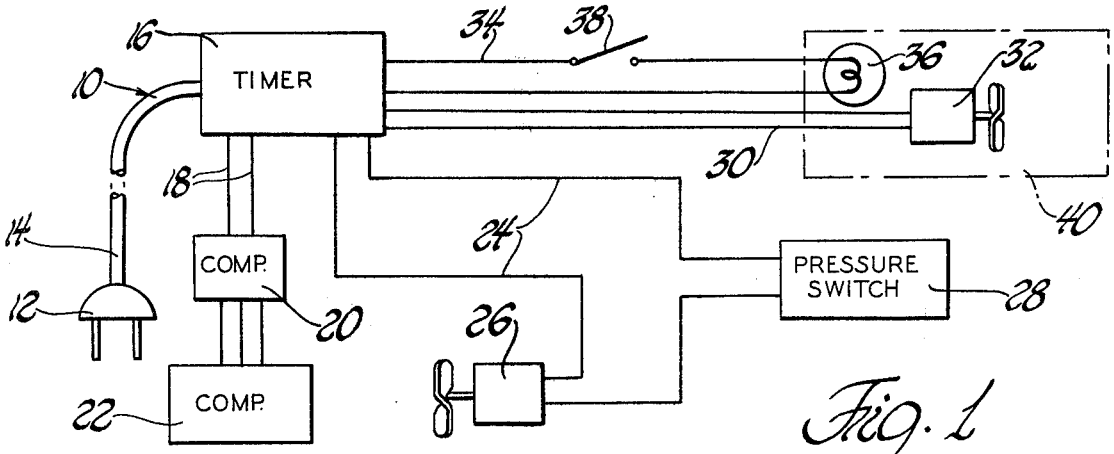
FIG. 1 is an electrical circuit diagram of the preferred embodiment of this invention.

FIG. 1 shows the preferred electrical circuit 10 of the preferred embodiment of this invention. A plug 12 connects to a source of electrical energy, preferably a 110 volt alternating current source such as commonly found in household circuits. An electrical conduit 14 feeds the electrical energy to a timing circuit 16. The timing circuit 16 may be such as a 7 day-24 hour timer commonly used to actuate lights and other ordinary household items. The timer may be provided with desired kick on and kick off settings.

Responsive to an active setting of the timing, electrical energy is provided along conduits 18 to an electrical box 20 on a compressor 22. The electrical box 20 contains a relay and capacitors commonly known in the art to be utilized in connection with compressors used in refrigeration apparatus. Responsive to actuation of the relays within the electrical box 20, the compressor 22 is actuated for operation.

In the preferred embodiment of this invention, a three-quarter horsepower compressor is utilized. This is a type of compressor ordinarily available for commercially available refrigerators used in households.

Conduits 24 provide electrical energy from the timer 16 to a circuit embodying a fan member 26 and a pressure responsive switch 28. The fan 26 is used in conjunction with a secondary condenser to be described hereinafter. It is a small fan utilized to conduct heat away from the secondary condenser, responsive to pressure being above a predetermined limit actuating the pressure switch 28. When the pressure switch 28 is actuated, the circuit including conduit 24 provides electric energy through the timer to the fan.

Conduits 30 provide electrical energy to a fan 32 that is used in conjunction with a quick cooler mechanism to be described hereinafter. By having the fan 32 continually operating responsive to the timer 16, a greater portion of the refrigerant cycle in the evaporators in the quick cooler is uitlized to reduce heat in the quick cooler area than would otherwise be available. This results because of parallel refrigerant circuits of similar evaporators used in a relatively higher temperature cooling apparatus for glasses, to be described hereinafter.

A circuit 34 provides electrical energy to a light 36, responsive to a closing of a switch 38. The circuit 34 provides electrical energy from the timer box 16 to turn on a light in the quick cooler mechanism 40, responsive to the opening of the door to the quick cooler in a manner commonly known in the art of refrigeration.

Figure 2:
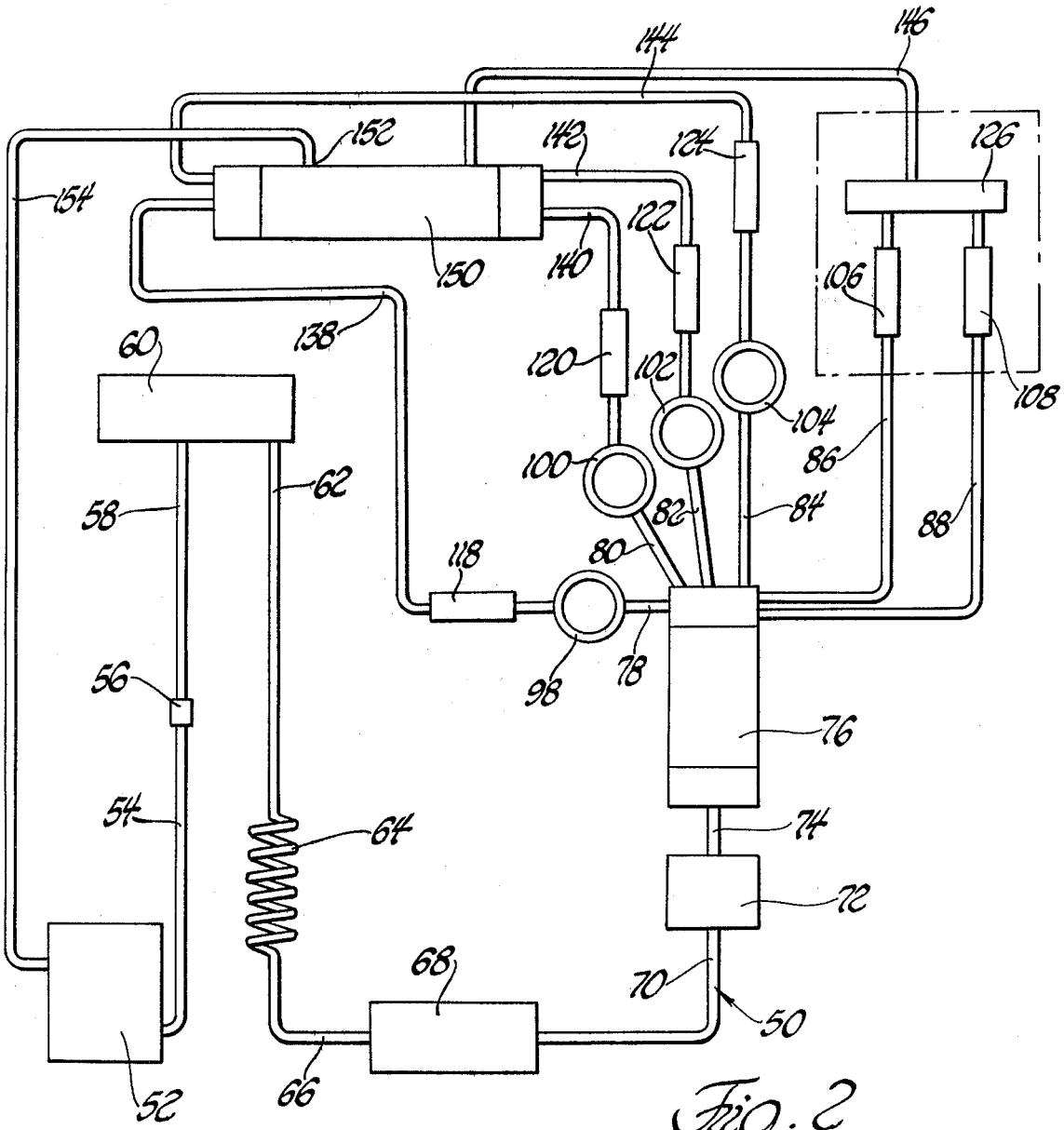
FIG. 2 is a flow chart indicative of the refrigerating cycle of the preferred embodiment of this invention.

FIG. 2 illustrates a refrigerant cycle 50. A compressor 52 compresses refrigerant, preferably Freon 12 because of its higher density, from a gaseous state into a liquid state in a manner well-known in the art of refrigeration. Compressor 52 is powered by a three-quarter horsepower motor and is connected electrically as discussed with regard to compressor 22 in FIG. 1. Copper tubing 54, preferably 5/16" in diameter, is provided to a pressure sensitive switch 56. Pressure sensitive switch 56 is operable to throw switch 28, as discussed in the electrical diagram illustrated in FIG. 1, above, responsive to pressure being above in predetermined limit.

In the preferred embodiment of this invention, such a limit is selected at 275 pounds per square inch within the tube. This threshold can be adjusted either higher or lower, depending upon design considerations as discussed hereinafter. When the pressure switch is actuated due to a rise of pressure above the predetermined threshold pressure, as mentioned before, the electrical switch 28 is actuated. This causes the fan 26 to cool the secondary condenser, as discussed hereinafter. When the pressure falls below the predetermined threshold level, the pressure switch 56 is deactuated from operation. This throws switch 28 back to its original position and causes the turning off of fan 26.

Conduit 58, being indentical in structure to conduit 54 conducts the refrigerant from the pressure switch 56 to primary condenser 60. In the preferred embodiment of this invention, primary condenser 60 has a power rating of approximately one horsepower. This is a larger power rated condenser than that ordinarily recommended by those skilled in the refrigeration art for a Freon 12 refrigerant condenser, even though a Freon 12 refrigerant is being utilized. By utilizing a one horsepower rated condenser for a different power rated Freon refrigerant, the capacity of such a condenser has a greater radiation capacity than one at a lower horsepower or lower power rating. However, by enclosing the primary condenser, in a manner to be described hereinafter, appropriate energy level of heat is obtained.

After the refrigerant passes through condenser 60, conduit 62, having identical structure to conduits 54 and 58, conducts the refrigerant through a coil 64 that is wrapped around portions of the compressor 52 (not shown). The coil 64 is made of identical 5/16" copper stock as are the conduits 54, 58 and 62. Preferably, eleven (11) coils are utilized in the preferred embodiment; however, a different number of coils may be utilized depending on the dimensions of the compressor and other heat characteristics of the system as a whole which may be determined from predetermined pressure switch operation and other desirable heat and temperature characteristics of the system.

The conduit 66 having identical structure as conduits 54, 58 and 62, conducts the refrigerant from the coil 64 to a secondary condenser 68. In the preferred embodiment of this invention, secondary condenser 68 is rated at one-quarter horsepower. The secondary condenser can be at a distance or removed from the table structure if so desired in order to dissipate additional heat away from the table. Alternatively, it can be integral with the table structure but located in a position within the table structure to dissipate heat at an appropriate location. The secondary condenser 68 will dissipate some heat as long as refrigeration passes through; however, the amount of heat conducted away by the secondary condenser will depend, in part, and to a great extent upon whether or not the fan 26, which would blow across such a condenser, is operating or not. In this manner, the amount of heat within the system can be regulated to at or near the threshold temperature of the pressure, and consequent temperature because of Boyles law, and consideration in connection with pressure switch mechanism 56.

A conduit 70 having similar physical properties as conduits 54, 58, 62 and 66 is provided to conduct refrigerant from the secondary condenser 68 to a drier mechanism 72. Drier mechanism 72 contains moisture absorbent material to remove moisture inadvertently generated within the refrigerant in passing through prior cycles. Such a mechanism has a structure and operates in a manner well-known to those having skills in the refrigeration art.

Conduit 74, having similar structure to conduits 54, 58, 62, 66 and 70, conducts the dried refrigerant from drier mechanism 72 to a copper tubing mechanism 76 used to distribute the refrigerant to various parallel circuits for refrigerant conduction. This distribution member 76 is essentially a cap mechanism utilizing $1\frac{1}{4}''$ copper tubing. Cap tubes, each being a 0.044 inches of inside circular mill dimension are provided for distribution from the distribution member 76 to parallel refrigerant circuits.

Cap tubes 78, 80, 82, 84, 86 and 88 distribute a refrigerant from the distributor 76 to evaporators 98, 100, 102, 104, 106 and 108 respectively.

Each of the evaporators 98, 100, 102 and 104 are identical evaporators made of $\frac{3}{8}''$ copper tubing. Each of the evaporators 98, 100, 102 and 104 are associated with glass cooling mechanisms described hereinafter.

Each of the evaporators 106 and 108 are rated at 1/6 horsepower and are associated with a quick cooler mechanism in a manner to be described hereinafter. $\frac{3}{4}''$ copper tubes are provided in oil collection conduits 118, 120, 122, 124, and 126 respectively. These oil collectors are to collect oil from and separated from the refrigerant after passing through the evaporators in a manner well-known to the refrigerant art. They also control temperature within cooling mechanisms associated with each of the aforementioned evaporators in order to control location of the frost line. These oil collectors 118, 120, 122 and 124 receive refrigerant after it passes through evaporators 98, 100, 102 and 104, respectively. Oil collector 128 receives refrigerant conducted in parallel from evaporators 106 and 108.

Conduits 138, 140, 142, 144, and 146, conduct refrigerant from the oil collectors 118, 120, 122, 124 and 126 respectively. Each of these conduits are made of copper tubing. Conduits 138, 140, 142 and 144 utilize $\frac{3}{8}''$ internal diameter copper tubing. Conduit 146 is $\frac{1}{2}''$ copper tubing. The differences in dimensions correspond to heavier refrigerant loads from the 1/6 horsepower evaporators used in conjunction with the quick cooler as compared to a smaller energy level and consequent smaller refrigerant flow from the other evaporators.

Each of the conduits 138, 140, 142, 144, 146 feed into a manifold 150. The manifold 150 is made of $1\frac{1}{4}''$ copper tubing which is a straight piece of pipe with end caps and having apertures for receiving of each of the aforementioned conduits. An additional aperture 152 is connected to a conduit 154, which is made of $\frac{5}{8}''$ copper tubing, feeding a refrigerant which was fed to the manifold 150 back to the compressor 52 completing the refrigeration cycle.

Figure 4:
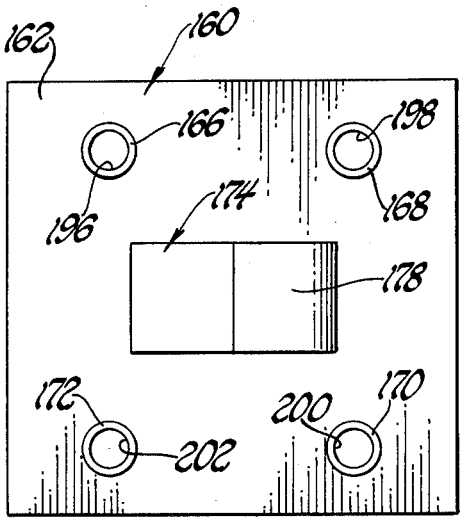
FIG. 4 is a top view of the preferred embodiment of this invention.
Figure 5:
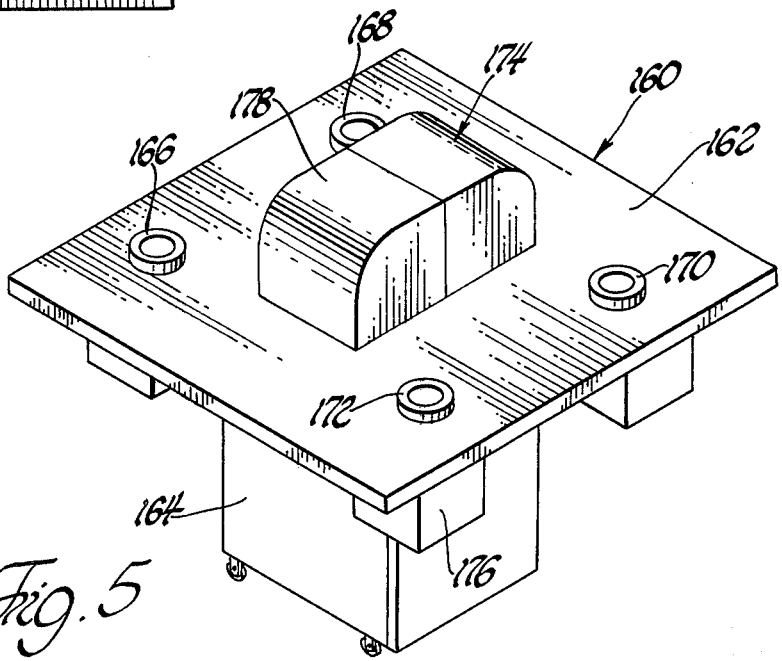
FIG. 5 is a perspective view of the preferred embodiment of this invention.

FIG. 4 illustrates a top view of the preferred embodiment of a table structure 160. The top 162 of the table 160 is illustrated. The table top 162 is supported by leg structure 164 (not shown in FIG. 4). Glass cooling mechanism 166, 168, 170 and 172 are provided near the corners of the table 162. The leg structure 164 is provided near the center of the table. A quick cooling mechanism 176 is provided near the warming mechanism 174 directly underneath it. Although the warming mechanism 174 is in the very center of the table, the quick cooling mechanism 176, although near the warming mechanism, is at some distance removed therefrom, being near one end of the table.

The warming mechanism 174 utilizes the heat from the primary condenser 60 and has an enclosure 178 to enclose the heat generated by the condenser. A fiberglass insulation material is utilized around the condenser 60 to contain the heat radiant therefrom proximate and near to the warmer 174. The insulation is on the sides and on the bottom in order to direct the heat upwards towards the top of the table at the warmer mechanism 174. A metal plate cover and hinged hood to confine the heat on top of the condenser 60 may be provided.

Figure 3:
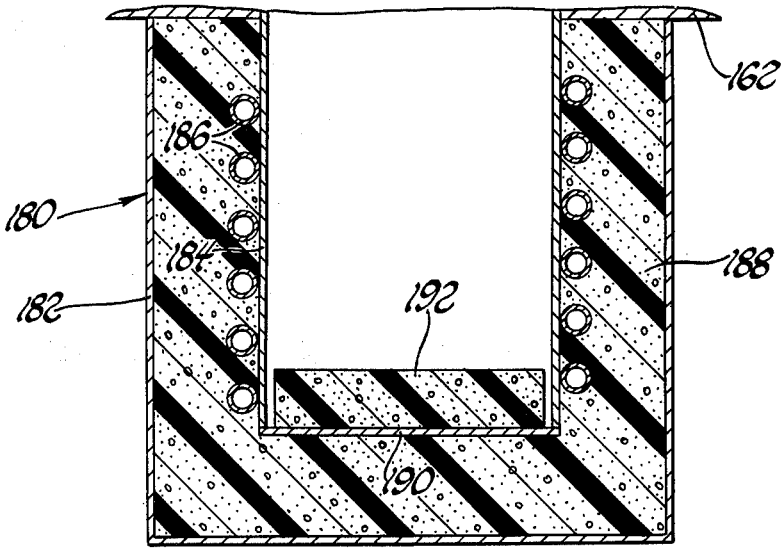
FIG. 3 is a cross-sectional view taken along the section lines 3—3 of FIG. 4, hereof.

Considerable insulation material, preferably fiberglass, is used in the quick cooler 176 to contain the coldness or lack of heat within an enclosed box that has an external metal surface. An additional internal metal surface is provided on the other side of the insulation. A door is provided to open and close to receive and take out and store food within the quick cooling mechanism. Also, a light turns on and off responsive to the opening and closing of the door. Each of the glass coolants 166, 168, 170 and 172 comprises a structure shown generally at 180 in FIG. 3. Each of these structures 166, 168, 170 and 172 are substantially identical and, therefore, a description of one of them which is shown in cross-section in FIG. 3, will be illustrative of the preferred embodiment of this invention with regard to the glass cooling mechanism.

The glass cooling mechanism 180 comprises an outer metal wall 182 and an inner metal wall 184. Coils of the evaporator 186 are wrapped around and proximate to the inner metal wall 184. An insulation of urethane foam 188 is provided between the outer and inner metal structures 182 and 186. A bottom aluminum plate 190 is provided for appropriate cool conduction characteristics of the cooler.

Additionally, in the preferred embodiment of this invention, a wet sponge 192 can be placed in the bottom of the metal container formed by the inner wall 184 and bottom plate 190 to provide additional cooling characteristics such as providing quick freezing for cooling of liquid in glasses placed in metal containers 184.

In the preferred embodiment of the invention, the inner metal wall 184 and bottom 190 are shaped to provide an enclosed bottom right circular cylinder with an open top, while the exterior metal structure 182 is in the shape of a square or rectangular structure.

As can be observed in FIG. 4, the open tops reveal circular outlines 196, 198, 200 and 202 for the receiving of glasses therein for cooling.

In the preferred embodiment of this invention, a rubber ring such as a belt used to drive a vacuum cleaner can be placed around the glass to provide a top seal for preventing heat from entering in the cold air vent below the level of the ring and reducing the cooling effect near the bottom of the glass.

I claim:

1. In a refrigeration device for food and beverages, the improvements comprising:

a compressor;

a primary condenser;

a secondary condenser;

a plurality of evaporators;

a fan operable to transmit heat away from said secondary condenser; means operable to conduct heat from said primary condenser to a heating device for food and beverages;

means operable to actuate said fan responsive to pressure in a refrigerant conduit conducting refrigerant from one of the aforesaid devices responsive to said refrigerant being above a predetermined pressure threshold;

said evaporators being arrayed in a plurality of subarrays;

a first one of said subarrays of evaporators maintaining a temperature substantially different from the temperature in another one of the subarrays of said evaporators.

2. In the apparatus of claim 1, copper tubing wrapped around the compressor;

said wrapped copper tubing cooperating with said primary condenser to increase the heat transfer.

3. In the apparatus of claim 1 said secondary condenser being displaced thermally from said primary condenser.

4. In the apparatus of claim 1 said heating device being in the center of a table.

5. In the apparatus of claim 4, said first subarray of evaporators being integral with glass cooling apparatus near the corners of said table.

6. In the apparatus of claim 4, a second subarray of said evaporators being within a cooling device maintaining a temperature lower than that maintained in glass coolers.

7. In the apparatus of claim 4 said other subarray of evaporators being within a cooling device located near the end of the table and at a distance thermally from glass coolers and maintaining a temperature lower than the temperature maintained in said glass coolers.

8. In the apparatus of claim 4, glass coolers comprising an inner metal container and an outer metal container and urethane foam insulation therebetween and copper evaporator tubes in said first subarray surrounding and substantially contiguous to said inner metal container for cooling glasses near the corners of said table.

9. In the apparatus of claim 4, glass coolers comprising inner and outer metal surfaces joined by integral urethane foam insulation and containing copper evaporator tubes being part of said first subarray contiguous to and radially exterior of said inner metal surface of cooling glasses inserted in the open tops thereof, and a wet sponge inserted at the bottom of said metal container prior to inserting the glasses therein for cooling, and a rubber belt around the exterior of glasses inserted into said glass coolers being above the bottom of said glasses and operable to contain the cooler ambient temperatures near the bottom of said glass.

* * * * *